US007651316B2

(12) United States Patent
Krüger et al.

(10) Patent No.: US 7,651,316 B2
(45) Date of Patent: Jan. 26, 2010

(54) CONVEYING MEMBER, ESPECIALLY ROTOR OR STATOR, FOR CONVEYING A FLOWABLE, PREFERABLY GASEOUS MEDIUM

(75) Inventors: Jan Krüger, Neuhausen (DE); Frank Castor, Esslingen (DE); Manfred Nicolai, Stuttgart (DE); Thomas Rose, Stuttgart (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 815 days.

(21) Appl. No.: 11/034,540

(22) Filed: Jan. 13, 2005

(65) Prior Publication Data

US 2005/0175483 A1 Aug. 11, 2005

(30) Foreign Application Priority Data

Jan. 13, 2004 (DE) ..... 10 2004 001 845

(51) Int. Cl.
*F04D 29/66* (2006.01)
*F04D 29/54* (2006.01)

(52) U.S. Cl. ..... 415/119; 415/195

(58) Field of Classification Search ..... 415/119, 415/195; 416/203, 500
See application file for complete search history.

(56) References Cited

U.S. PATENT DOCUMENTS 3,556,680 A * 1/1971 Leutwyler et al. ..... 417/64
3,951,567 A 4/1976 Rohs
4,923,365 A 5/1990 Rollwage
5,342,167 A 8/1994 Rosseau
5,681,145 A 10/1997 Neely et al.
7,029,227 B2 * 4/2006 Berthillier et al. ..... 415/1
2002/0127109 A1 9/2002 Masuo

FOREIGN PATENT DOCUMENTS

DE 21 63 011 6/1973
DE 25 24 555 12/1975
DE 38 08 336 9/1988
DE 39 39 957 6/1991
EP 0 921 274 6/1999
WO WO02092969 A1 * 11/2002 ..... 415/1

* cited by examiner

*Primary Examiner*—Edward Look
*Assistant Examiner*—Nathaniel Wiehe
(74) *Attorney, Agent, or Firm*—McGlew and Tuttle, P.C.

(57) ABSTRACT

A conveying member, especially a rotor or stator, for conveying a flowable, preferably gaseous medium, comprises a plurality of blades (S1-S7) arranged following each other with a circumferential distance in a circumferential direction (U) around a central axis (A). Either a first circumferential distance (a) or a second circumferential distance (b) differing from the first circumferential distance (a) is provided between a blade and a respective blade following it in the circumferential direction (U) in a group of blades directly following each other in a circumferential direction (U), which the group comprises at least some of the blades (S1-S7). The first circumferential distance (a) is provided between at least two blades (S1-S7) located directly adjacent to one another, and the second circumferential distance is provided between at least two blades (S1-S7) located directly adjacent to one another.

17 Claims, 2 Drawing Sheets

CONVEYING MEMBER, ESPECIALLY ROTOR OR STATOR, FOR CONVEYING A FLOWABLE, PREFERABLY GASEOUS MEDIUM

CROSS REFERENCE TO RELATED APPLICATIONS

This application claims the benefit of priority under 35 U.S.C. § 119 of German patent application DE 10 2004 001 845.6 filed Jan. 13, 2004 the entire contents of which are incorporated herein by reference.

FIELD OF THE INVENTION

The present invention pertains to a conveying member, i.e., e.g., a rotor or a stator, by which a fluid or flowable medium, generally a gaseous medium, but, for example, also a liquid medium is conveyed forward.

BACKGROUND OF THE INVENTION

A conveying wheel of a half-shell-like design is equipped with a plurality of blades following each other in the circumferential direction around an axis of rotation of a conveying wheel, for example, in so-called side channel fans, as they are used in parking heaters or auxiliary heaters of motor vehicles to convey the combustion air. This conveying wheel rotates with its area carrying the blades above a ring channel at a housing, which ring channel is open on its side facing the conveying wheel. Due to the rotation of the conveying wheel, the air to be conveyed is drawn in through an inlet opening, compressed and conveyed forward and released in the area of an outlet opening. A so-called interruption, by which the channel provided in the housing, which otherwise passes through in an annular pattern, is interrupted, is arranged between the inlet opening and the outlet opening.

Periodic excitations are generated due to the fact that blades move periodically past stationary component areas, e.g., the interrupter, during the conveying operation. The excitation frequency corresponds to the speed of the conveying wheel multiplied by the number of blades provided at the conveying wheel. A so-called edge tone with a characteristic frequency in the range of about 1,500 Hz, which is superimposed to the rest of the noise spectrum and markedly differs from this spectrum, may be generated by this excitation. To reduce the perceptibility of this tone or such noises, mufflers are frequently used to make it difficult to transport the noise in the medium being conveyed, i.e., the air.

A side channel fan, in which the blades are arranged at irregular relative distances from one another to avoid such characteristic noises, is known from DE 39 39 957 A1. The deviation of the mutual distance is suggested here to be in the range of ±20%, and the distribution is the to be, in principle, statistical, and it is the that all the distances may even be different from one another, even though the development of an imbalance shall be prevented from occurring by corresponding positioning of the blades.

SUMMARY OF THE INVENTION

The object of the present invention is to provide a conveying member, especially a rotor or a stator, for conveying a flowable medium, by which conveying member the generation of the characteristic noise occurring during operation can be further reduced.

This object is accomplished according to the present invention by a conveying member, especially a rotor or a stator, for conveying a flowable, preferably gaseous medium, comprising a plurality of blades arranged following each other at circumferentially spaced locations in a circumferential direction around a central axis, wherein either a first circumferential distance or a second circumferential distance different from the first circumferential distance from a respective blade following in the circumferential direction is provided in a group of blades directly following each other in a circumferential direction, which group comprises at least some of the blades, and wherein the first circumferential distance is provided between at least two blades located directly adjacent to one another, and the second circumferential distance is provided between at least two blades located directly adjacent to one another.

It is elementary in the present invention that a markedly better noise quality can be achieved compared with a statistical circumferential distribution with a plurality of any desired circumferential distances due to the transition from a distribution of the blades that is a statistical distribution concerning the mutual circumferential distance, i.e., in principle, from the statistical selection of the mutual circumferential distance from any desired, nevertheless limited range of circumferential distances, to only two possible circumferential distances at least in a group of blades.

It is advantageous in this connection for the first circumferential distance and the second circumferential distance to occur at least twice in the group of blades, preferably if the circumferential distance of a blade from a blade directly following it in the circumferential direction is either the first circumferential distance or the second circumferential distance for all blades at the conveying member. However, a markedly improved noise quality can also be achieved in comparison to the positioning of the blades with a plurality of different circumferential distances from one another already if the group of blades comprises at least half the blades provided at the conveying member or if there is only one blade for which the circumferential distance between it and the blade directly following it in the circumferential direction is not the first circumferential distance and also not the second circumferential distance for only one blade.

Provisions may be made in another, further optimized variant of the conveying member according to the present invention if the sequence of the first circumferential distance and the second circumferential distance in the circumferential direction in the blades of the group of blades corresponds to a pseudostatistical binary sequence or a partial sequence thereof, wherein each of the two binary states corresponds to one circumferential distance of the first circumferential distance and the second circumferential distance. A nearly uniform noise without characteristic frequency increases can be obtained due to the selection of the distribution of the circumferential distances, generally also called maximum sequence.

Provisions may be made, in particular, in the conveying member according to the present invention for the number n of blades to be defined by $$n=2^Z-1,$$

in which: Z=2, 3, 4, 5, 6, . . . , i.e., a positive integer greater than 1.

Provisions are preferably made, furthermore, for one circumferential distance of the first circumferential distance and the second circumferential distance to occur in the group of blades at a frequency of $0.5\times2^Z$ and for the other circumferential distance of the first circumferential distance and the second circumferential distance to occur at a frequency of $0.5\times2^{Z}-1$.

To make it possible to set a condition for the first circumferential distance and the second circumferential distance in a simple manner especially also when the number of blades is taken into account, it is proposed, furthermore, that the first circumferential distance and the second circumferential distance be represented as an angular distance by:

$$\text{first circumferential distance } (a)=\alpha_0-\beta$$

$$\text{second circumferential distance } (b)==\alpha_0+\beta$$

in which:

$\alpha_0$=angle range that is covered by the group of blades, divided by n n=number of circumferential distances β=amount of change in circumferential distance and, furthermore:

$$\beta<180°/n.$$

It shall be pointed out that in a case in which the group of blades comprises all blades of the conveying member, the first circumferential distance or the second circumferential distance can also be provided between the first blade of the group and the last blade of the group, so that the group is closed in itself in a ring-shaped manner. This means that the number of intermediate spaces between individual blades of the group of blades is equal to the number of blades. If the distance between the first blade and the last blade is not the first circumferential distance or the second circumferential distance, or if the group of blades does not comprise all blades, the number of intermediate spaces between the individual blades of the group of blades is smaller by 1 than the number of blades if the first blade, which does not have either the first circumferential distance or the second circumferential distance from a blade following it in the circumferential direction, is not interpreted as the blade ending the group, either. If this blade is not considered part of the group, the group of blades ends with a circumferential distance concerning the angle range covered by same, so that the same coverage angle can be assumed, in principle, as in the case in which the above-mentioned blade is still considered part of the group, but the number of blades corresponds to the number of circumferential distances of the group. In the case in which the group of blades comprises all blades and is, moreover, closed in an annular pattern, i.e., only the first circumferential distance and the second circumferential distance occur at the conveying member, the angle range covered by the group of blades, i.e., all blades, corresponds to the total angle range of 360°. If, for example, neither the first circumferential distance nor the second circumferential distance is provided between the first blade and the last blade or the group of blades does not comprise all blades, the angle range covered by that group from the first blade to the last blade of the group of blades is, in principle, smaller than 360°.

As an alternative, provisions may be made for the first circumferential distance and the second circumferential distance to be represented as an angular distance by:

$$\text{first circumferential distance } (a)=\alpha_0-\beta+\Delta$$

$$\text{second circumferential distance } (b)=\alpha_0+\beta+\Delta,$$

in which $\alpha_0$=angle range that is covered by the group of blades, divided by n, n=number of circumferential distances, β=amount of change in circumferential distance, and, furthermore:

$$\beta<180°/n$$

and $$\Delta=+x\cdot\beta/n,$$

if the frequency of the first circumferential distance is greater by the number x than the frequency of the second circumferential distance in the group of blades, $$\Delta=-x\cdot\beta/n$$

if the frequency of the second circumferential distance is greater by x than the frequency of the first circumferential distance in the group of blades.

The fact that the first circumferential distance and the second circumferential distance may not possibly occur at equal frequency is taken into account in this variant and it can be ensured by introducing the correction term Δ that all blades of the group can have either the first or second circumferential distance from the blade of the group following it in the circumferential direction.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

The present invention will be described in detail below with reference to the figures attached. In the drawings.

DESCRIPTION OF THE PREFERRED EMBODIMENTS

The design of the conveying member according to the present invention will be described below in reference to a conveying wheel generally designated by 10 in FIG. 1, as it can be used, for example, in a so-called side channel fan. The more specific design of such a side channel fan, which is known per se, will not be explained in greater detail here. However, reference is made in this connection, for example, to DE 39 39 957 A1, which was mentioned in the introduction and shows this general design.

On a hub 12, which represents equally a shell or a housing of the conveying wheel 10, the conveying wheel 10 according to the present invention has a plurality of blades S1-S7 distributed in such a way that they follow each other in the circumferential direction around an axis of rotation or a center A of this conveying wheel 10. It can be recognized that the blades directly following each other in the circumferential direction U have either a circumferential distance a or a circumferential distance b from one another. Thus, a sequence of circumferential distances a, b that is described by the binary sequence:

a a a b a b b is obtained.

This binary sequence, of which each of the two binary states a and b represents one of the two angular distances that are possible here between two blades $S_i$ (i=1 . . . 7) directly following one another, corresponds in the example being shown to a so-called third-order pseudostatistical binary sequence or maximum sequence. Such a third-order pseudostatistical binary sequence has $2^3-1$ (=7) members, each of which consequently represents a circumferential distance here. It shall be pointed out here that the term "circumferential distance" in the sense of the present invention means the circumferential position or relative circumferential position assumed by the individual blades $S_i$ at the conveying member. For example, the circumferential distance, if it is represented as an angular distance, may reflect the circumferential angle between two reference points or reference ranges at the blades being considered, the reference points or reference ranges to be selected at the different blades corresponding to one another.

Figure 1:
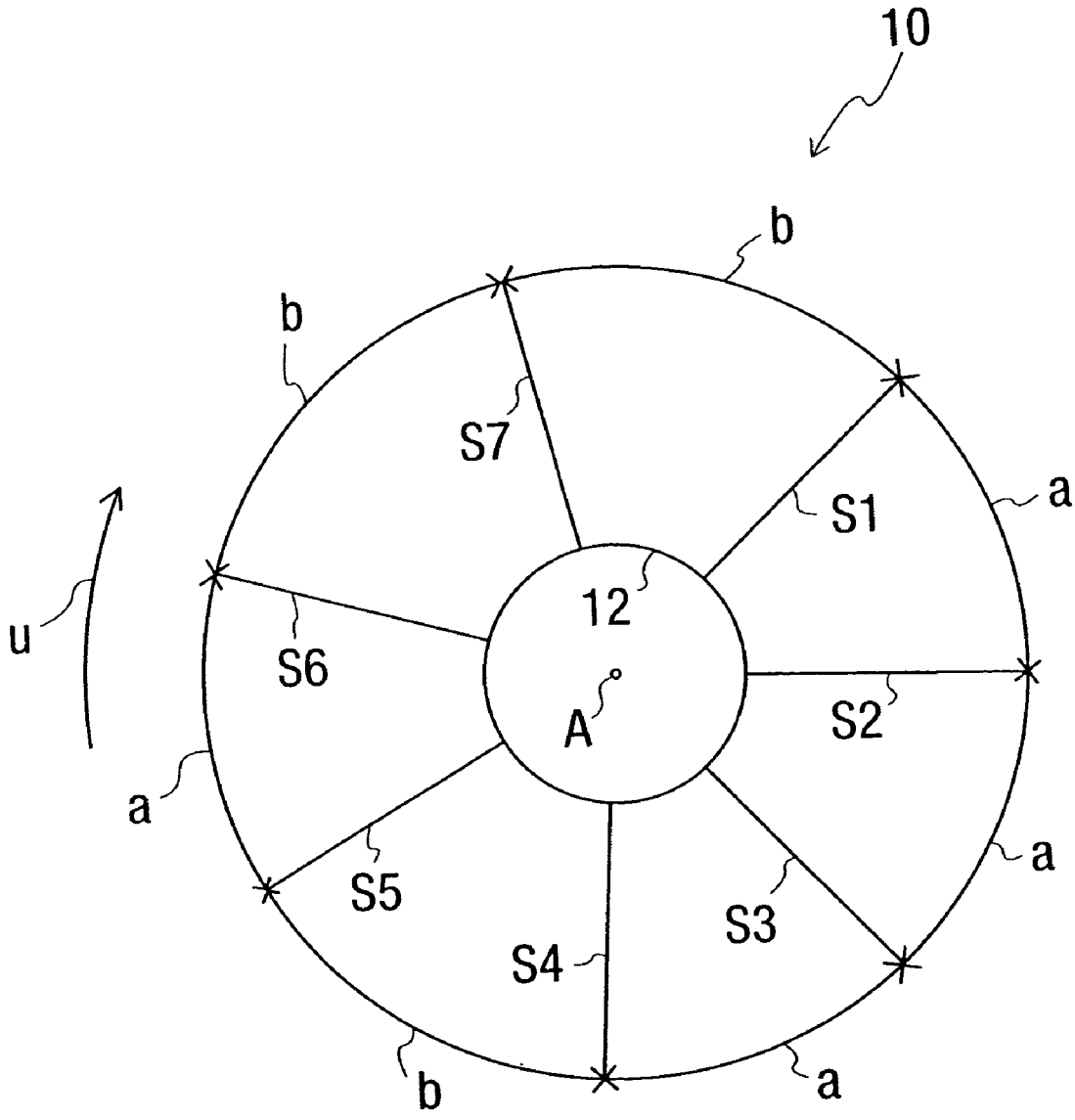
FIG. 1 is a view showing the general design of a conveying wheel designed according to the present invention.

It is consequently recognized that, on the one hand, the number of blades S1-S7 corresponds to the number of terms of a third-order pseudostatistical binary sequence, i.e., equals 7, in the blade wheel shown in FIG. 1. and that, moreover, the sequence of binary states that are present in this binary sequence also corresponds to the sequence of a third-order pseudostatistical binary sequence. This is, of course, not the only third-order pseudostatistical binary sequence. Rather, a group totaling seven such third-order pseudostatistical binary sequences can be identified by cyclically permuting the end terms of this binary sequence.

Due to the individual blades $S_i$ being arranged in the sequence indicated, i.e., in the pattern of a pseudostatistical binary sequence, it is achieved that the noises generated during the movement past a stationary assembly unit, e.g., the interrupter or a side channel fan, will have a continuous spectrum essentially in the form of a white noise, without prominent elevations of the spectrum being present at certain frequencies. The development of so-called edge tones is thus avoided in side channel fans that are equipped with the conveying member 10 according to the present invention.

Figure 2:
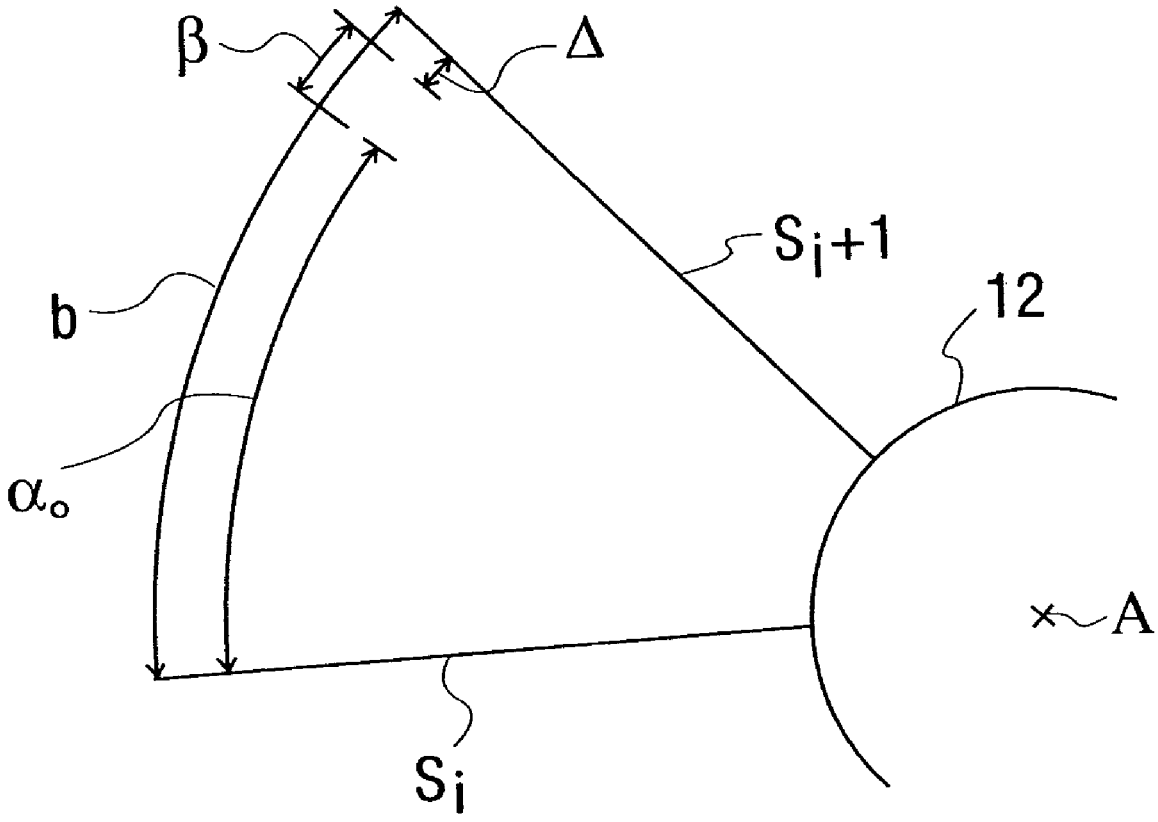
FIG. 2 is a detail view of the conveying wheel shown in FIG. 1.

It will also be described below in reference to FIG. 2 how the individual angular distances a and b are determined in the conveying wheel 10 shown in FIG. 1. FIG. 2 shows a detail showing two blades $S_i$ and $S_{i+1}$ that directly follow each other. These have the angular distance b between them. This angular distance b is composed of a total of three angle components. These are, on the one hand, an angle $\alpha_0$, as well as two smaller angles β and Δ. The angle $\alpha_0$ corresponds to a basic angle, which can be determined, for example, by dividing the total available angle range of 360° by the number n of blades or circumferential distances a, b present in the conveying wheel 10. In case of the conveying wheel 10 according to FIG. 1, the number n would be equal to 7, so that a value of about 51.4° is obtained for the basic angle $\alpha_0$.

The angle β represents a change angle by which the blades $S_i$ and $S_{i+1}$ directly following each other are displaced in relation to one another basically regarding one another starting from the basic angle $\alpha_0$. Consequently, the change angle β is added to the basic angle $\alpha_0$ in case of the greater of the two possible angular distances b. It is also recognized from FIG. 1 that the greater angular distance b occurs only three times, whereas the smaller angular distance a occurs four times. This is, among other things, the consequence of the fact that the number of occurrences of one of the binary states in each pseudostatistical binary sequence that has, in principle, an odd number of terms is one higher than the number of occurrences of the other binary state. The occurrence of the binary state a, i.e., the smaller angular distance a, is higher in this case by one than that of the angular distance b. If the basic angle $\alpha_0$ were now decreased or increased to determine the angular distances a and b by the increase angle β, which may be 5° in a hypothetical example, this would lead to an angle of about 46.4° for the angular distance a and to an angle of about 56.4° for the angular distance b. This would yield an overall angle of about 355° in the case of the conveying wheel 10 shown in FIG. 1, because 5° is subtracted once more than it is added. However, to ensure that only the angle a or the angle b can be present between all blades directly following each other in the circumferential direction even in case of blades S1-S7 arranged in such a way that they follow each other in a cyclic pattern, a correction term Δ is introduced, which is defined by the value of the increase angle β divided by the number of blades or intermediate spaces between these, i.e., it equals about 0.7° in the hypothetical case. This correction term Δ is added to each angle $\alpha_0+\beta$ or $\alpha_0-\beta$ in order to again obtain a sum of 360°. It would be possible to follow the same procedure if the angular distance b were present at a frequency of 4, whereas the angular distance a were now present at the frequency of 3. However, the correction term Δ would have a negative sign in this case and would consequently lead basically to a reduction of the mutual angular distances. If, for example, one of the angular distances a, b were present at a frequency that is greater by more than 1 than the frequency of the other angular distance, which would be possible in case of a deviation from a pseudostatistical binary sequence and a changeover to any other desired binary sequence, the correction term Δ would be obtained from the change angle β multiplied by the frequency difference (this was 1 in the previous case) and divided by the number of blades or intermediate spaces between these.

As was already described above, a substantial reduction of the noises generated during the rotation can be achieved by arranging the blades $S_i$ at a mutual circumferential distance that corresponds to a binary sequence. An optimization can be achieved in case of arrangement according to a pseudostatistical binary sequence. However, an improvement in terms of the noise quality can already be achieved, in principle, if the mutual circumferential distance is selected according to such a binary sequence in one group of blades $S_i$ only, while other blades that have a different circumferential distance may be present as well. This would happen, for example, if the correction term Δ is not introduced even in case of a selection according to a pseudostatistical binary sequence and an angular distance that is now displaced by the value β regarding the other binary states is thus present. However, the group is preferably closed in itself in this case, i.e., it is not interrupted in the circumferential direction. However, provisions should be made according to an advantageous aspect for at least half of all blades $S_i$ to be contained in this group.

Concerning the various parameters mentioned in connection with the determination of the circumferential distances, it can be recognized from the previous example that the basic angle $\alpha_0$ corresponds, in principle, to the angle that is covered by the group of blades for which the relative distance is selected according to a binary sequence. In the group of blades shown especially in FIG. 1, which is a group closed in a cyclic pattern and consequently comprises all blades of the conveying wheel 10, this basic angle $\alpha_0$ can be determined by dividing the overall angle by the number of blades and consequently also by the number of intermediate spaces between the individual blades. However, if the group does not comprise all blades or if the correction term Δ mentioned shall not be introduced, e.g., in case of a binary sequence that is to comprise all blades, so that a different circumferential distance is present between the first blade and the last blade, the basic angle $\alpha_0$ between the individual blades of the group of blades is to be determined by dividing the angle covered by the group of blades by the number of blades reduced by the number 1 if the group of blades is ended by the first blade, which does not have the first circumferential distance or the second circumferential distance from the blade following it in this case, because the number of blades is now greater by one than the number of circumferential distances. However, if the group of blades is defined by the blades with the circumferential distance following them in the circumferential direction, the group of blades does not end with a blade but with a circumferential distance in the circumferential direction, so that the number of circumferential distances present equals the number of blades in the group and the division is therefore performed only by the number of blades and consequently also the number of circumferential distances. In the case, in particular, in which the group of blades is not closed in an annular pattern and an angular distance or a distance that differs from the two distances occurring in the group of blades is therefore present between at least two blades of the conveying wheel, the introduction of the correction term $\Delta$ mentioned can be omitted.

A conveying wheel 10 in which the conveying blades S1-S7 are arranged according to the condition of a third-order pseudostatistical binary sequence was described and shown above also with reference to FIG. 1. It is obvious that pseudostatistical binary sequences of a higher order may be used as well. For example, a conveying wheel would be equipped with $2^4-1(=15)$ blades in case of a fourth-order pseudostatistical binary sequence. One of the 15 possible third-order pseudostatistical binary sequences would be given, for example, by a a a a b a b a a b b a b b b.

The binary states a and b represent one of two possible angle states here as well. It shall be pointed out here that the manner in which such pseudostatistical binary sequences can be identified is known and was published, for example, in *Proceedings of the IEEE*, Vol. 64, No. 12, December 1976, "Pseudo-Random Sequences and Arrays," by F. Jessie MacWilliams and Neil J. A. Sloane, member, IEEE. All 15 possible pseudostatistical binary sequences that can be obtained by cyclic permutation are shown there, especially also with reference to a fourth-order pseudostatistical binary sequence. It is, of course, also possible to use even higher-value pseudostatistical binary sequences to determine the number of blades and also of the mutual distances. A fifth-order pseudostatistical binary sequence with $2^5-1(=31)$ terms is given, for example, by a a a a a b b a a b a b b a b b b b a b a b a a a b a a b b b.

It shall pointed out here that this is only one of 31 possible fifth-order pseudostatistical binary sequences. It is, of course, also possible, if necessary, to use even higher-value sequences, always depending on how high the number of blades to be used shall be.

It is pointed out in conclusion that if the blades are arranged according to a pseudostatistical binary sequence, it is also possible, in principle, to interrupt this binary sequence in certain areas, for example, by providing a circumferential distance that does not correspond either to the first circumferential distance or the second circumferential distance in one intermediate area, but the binary sequence is continued thereafter and is optionally interrupted once again or several times. A marked improvement of the noise quality compared with the state of the art can also be achieved as a result of this. In particular, it becomes possible as a result to increase the number of blades in deviation from a binary sequence, so that a sequence of circumferential distances represented essentially by a binary sequence is provided, distributed, in principle, over the entire circumference. To reduce the number of circumferential distances, it is possible to omit one or more of the terms of a binary sequence, for example, the last one, or a group at the end of the binary sequence, so that a sequence according to a binary sequence, which is, however, not a complete one now, is essentially provided here as well, distributed over the circumference.

While specific embodiments of the invention has been shown and described in detail to illustrate the application of the principles of the invention, it will be understood that the invention may be embodied otherwise without departing from such principles.

What is claimed is:

1. A conveying member including one of a rotor or stator for conveying a flowable, medium, the conveying member comprising:

a plurality of blades arranged following each other with a circumferential distance around a central axis, wherein either a first circumferential distance or a second circumferential distance differing from the first circumferential distance between a blade and a respective blade following said blade in the circumferential direction is provided in a group of blades directly following each other in a circumferential direction, said group comprising at least part of the blades, and wherein the first circumferential distance is provided between at least two of said blades located directly adjacent to one another, and the second circumferential distance is provided between at least two blades located directly adjacent to one another;

a sequence of the first circumferential distance and the second circumferential distance in the circumferential direction corresponds to a pseudostatistical binary sequence for the blades of the group of the blades, wherein each of the two binary states corresponds to one of the circumferential distances of the first circumferential distance and the second circumferential distance, the number n of the blades being defined by $$n=2^Z-1,$$

in which: Z=2, 3, 4, 5, 6 . . . .

2. A conveying member in accordance with claim 1, wherein the first circumferential distance and the second circumferential distance are provided at least twice for the blades of the group of blades.

3. A conveying member in accordance with claim 1, wherein the circumferential distance from a blade following directly in the circumferential direction is either the first circumferential distance or the second circumferential distance for all the blades.

4. A conveying member in accordance with claim 1, wherein the circumferential distance from the blade following directly in the circumferential direction is not the first circumferential distance and also not the second circumferential distance for one blade only.

5. A conveying member in accordance with claim 1, wherein the group of blades comprises all of the blades.

6. A conveying member in accordance with claim 1, wherein one circumferential distance of the first circumferential distance and the second circumferential distance occurs at a frequency of $0.5\times2^Z$ in the group of the blades and the other circumferential distance of the first circumferential distance and the second circumferential distance occurs at a frequency of $0.5\times2^Z-1$.

7. A conveying member in accordance with claim 6 wherein the first circumferential distance and the second circumferential distance are represented as an angular distance by:

$$\text{a first circumferential distance}=\alpha_0-\beta$$

$$\text{a second circumferential distance}=\alpha_0+\beta$$

in which:

$\alpha_0$=angle range that is covered by the group of the blades, divided by n, n=number of circumferential distances, $\beta$=amount of change in the circumferential distance, and furthermore:

$$\beta<180°/n$$

and one circumferential distance is the first circumferential distance and the other circumferential distance is the second circumferential distance.

8. A conveying member in accordance with claim 1, wherein the first circumferential distance and the second circumferential distance are represented as an angular distance by:

$$\text{a first circumferential distance}=\alpha_0-\beta$$

$$\text{a second circumferential distance}=\alpha_0+\beta$$

in which:

$\alpha_0$=angle range that is covered by the group of the blades, divided by n, n=number of circumferential distances, $\beta$=amount of change in the circumferential distance, and furthermore:

$$\beta<180°/n.$$

9. A conveying member in accordance with claim 1, wherein the first circumferential distance and the second circumferential distance are represented as angular distances by:

$$\text{a first circumferential distance}=\alpha_0-\beta+\Delta$$

$$\text{a second circumferential distance}=\alpha_0+\beta+\Delta$$

in which:

$\alpha_0$=angle range that is covered by the group of blades, divided by n, n=number of circumferential distances, $\beta$=amount of change in circumferential distance, and furthermore:

$$\beta<180°/n$$

and $$\Delta=+x\cdot\beta/n$$

when the frequency of the first circumferential distance in the group of the blades is greater than the frequency of the second circumferential distance by the number x, $$\Delta=-x\cdot\beta/n/n,$$

when the frequency of the second circumferential distance in the group of the blades is greater than the frequency of the first circumferential distance by the number x.

10. A conveying member for conveying a fluid, the conveying member comprising:

a plurality of the blades arranged following each other with a circumferential distance around a central axis, said blades directly following each other in a circumferential direction being spaced apart either a first circumferential distance or a second circumferential distance differing from said first circumferential distance;

a sequence of the first circumferential distance and the second circumferential distance in the circumferential direction corresponding to a pseudostatistical binary sequence with first and second binary states, wherein said first binary state corresponds to said first circumferential distance and said secondary binary state corresponds to said second circumferential distance, the number n of the blades being defined by $$n=2^Z-1$$

in which: Z=2, 3, 4, 5, 6 . . . .

11. A conveying member in accordance with claim 10, wherein said plurality of blades comprises all of the blades around said central axis.

12. A conveying member in accordance with claim 10, wherein one circumferential distance of the first circumferential distance and the second circumferential distance occurs at a frequency of $0.5\times2^Z$ in the group of the blades and the other circumferential distance of the first circumferential distance and the second circumferential distance occurs at a frequency of $0.5\times2^Z-1$.

13. A conveying member in accordance with claim 10, wherein the first circumferential distance and the second circumferential distance are represented as an angular distance by:

$$\text{a first circumferential distance}=\alpha_0-\beta$$

$$\text{a second circumferential distance}=\alpha_0+\beta$$

in which:

$\alpha_0$=angle range that is covered by the group of the blades, divided by n, n=number of circumferential distances, $\beta$=amount of change in the circumferential distance, and furthermore:

$$\beta<180°/n.$$

14. A conveying member in accordance with claim 10, wherein the first circumferential distance and the second circumferential distance are represented as angular distances wherein:

$$\text{the first circumferential distance}=\alpha_0-\beta+\Delta;$$

$$\text{the second circumferential distance}=\alpha_0+\beta+\Delta;$$

in which:

$\alpha_0$=angle range that is covered by the group of blades, divided by n, n=number of circumferential distances, $\beta$=amount of change in circumferential distance, and furthermore:

$$\beta<180°/n$$

and $$\Delta=+x\cdot\beta/n,$$

when the frequency of the first circumferential distance in the group of the blades is greater than the frequency of the second circumferential distance by the number x, $$\Delta=-x\cdot\beta/n/n,$$

when the frequency of the second circumferential distance in the group of the blades is greater than the frequency of the first circumferential distance by the number x.

15. A conveying member for conveying a fluid, the conveying member comprising:

a plurality of the blades arranged following each other with a circumferential distance around a central axis, said blades directly following each other in a circumferential direction being spaced apart either a first circumferential distance or a second circumferential distance differing from said first circumferential distance;

a sequence of the first circumferential distance and the second circumferential distance in the circumferential direction corresponding to a pseudostatistical binary sequence with first and second binary states, wherein said first binary state corresponds to said first circumferential distance and said secondary binary state corresponds to said second circumferential distance, the first circumferential distance and the second circumferential distance are represented as angular distances wherein:

$$\text{the first circumferential distance}=\alpha_0-\beta+\Delta;$$

$$\text{the second circumferential distance}=\alpha_0+\beta+\Delta;$$

in which:

$\alpha_0$=angle range that is covered by the group of blades, divided by n, n=number of circumferential distances, $\beta$=amount of change in circumferential distance, and furthermore:

$$\beta<180°/n$$

and $$\Delta=+x\cdot\beta/n,$$

when the frequency of the first circumferential distance in the group of the blades is greater than the frequency of the second circumferential distance by the number x, $$\Delta=-x\cdot\beta/n/n,$$

when the frequency of the second circumferential distance in the group of the blades is greater than the frequency of the first circumferential distance by the number x.

16. A conveying member in accordance with claim 15, wherein the first circumferential distance and the second circumferential distance are provided at least twice for the blades of the group of blades.

17. A conveying member in accordance with claim 15, wherein the group of blades comprises at least half of the blades.

* * * * *